US008830087B2

(12) United States Patent
Tijink et al.

(10) Patent No.: US 8,830,087 B2
(45) Date of Patent: Sep. 9, 2014

(54) BEACON FOR A ROAD TOLL SYSTEM

(75) Inventors: Jasja Tijink, Breitenfurt (AT); Robert Povolny, Vienna (AT); Gerald Zottl, Groβweikersdorf (AT)

(73) Assignee: Kapsch TrafficCom AG, Wien (AT)

( * ) Notice: Subject to any disclaimer, the term of this patent is extended or adjusted under 35 U.S.C. 154(b) by 180 days.

(21) Appl. No.: 13/088,971

(22) Filed: Apr. 18, 2011

(65) Prior Publication Data

US 2011/0263207 A1 Oct. 27, 2011

(30) Foreign Application Priority Data

Apr. 22, 2010 (EP) ..... 10450066

(51) Int. Cl.
*G08G 1/00* (2006.01)
*G07B 15/06* (2011.01)

(52) U.S. Cl.
CPC ..... *G07B 15/063* (2013.01)
USPC ..... 340/928; 340/933; 340/942; 340/988; 455/25; 455/62; 455/63.1; 455/63.4; 455/450; 370/322; 370/341; 370/344; 370/348; 235/384

(58) Field of Classification Search
CPC ..... G08G 1/017; G08G 1/0175; G08G 1/042; G08G 1/123; H04B 15/00; H04B 17/00; H04B 7/0408; H04B 1/525; H04W 72/042; H04W 72/04; H04W 72/0406; H04W 74/0833; H04W 72/0413; H04W 76/021; H04W 24/02; H04W 16/14; H04W 72/082; H04W 48/16; H04W 72/00; H04W 88/06; G06Q 10/08; G06Q 10/087; G06Q 10/02; G06Q 30/02; G07B 15/00; G07B 15/02; G07B 15/063; G07C 9/00087
USPC ..... 340/928, 933, 935, 942, 988, 934, 937; 455/25, 62, 63.1, 63.4, 66.1, 450, 509; 370/322, 348, 344, 341, 329; 235/384
See application file for complete search history.

(56) References Cited

U.S. PATENT DOCUMENTS

| | | | | |
|---|---|---|---|---|
| 7,321,580 | B1 | 1/2008 | Ramanathan et al. | |
| 7,359,679 | B2 * | 4/2008 | King et al. | 455/101 |
| 7,990,944 | B2 * | 8/2011 | Stanwood et al. | 370/350 |
| 8,013,760 | B2 * | 9/2011 | Turnock et al. | 340/928 |
| 2005/0234778 | A1 * | 10/2005 | Sperduti et al. | 705/22 |
| 2007/0096909 | A1 * | 5/2007 | Lally | 340/572.1 |
| 2008/0117865 | A1 * | 5/2008 | Li et al. | 370/329 |
| 2009/0201169 | A1 * | 8/2009 | d'Hont et al. | 340/825.49 |
| 2009/0231161 | A1 | 9/2009 | Malarky | |

FOREIGN PATENT DOCUMENTS

EP 1 876 570 A1 1/2008

OTHER PUBLICATIONS

Extended European Search Report for corresponding European Patent Application No. 10 450 066.5, 7pp., Sep. 17, 2010.

* cited by examiner

*Primary Examiner* — George Bugg
*Assistant Examiner* — Sharmin Akhter
(74) *Attorney, Agent, or Firm* — Fiala & Weaver P.L.L.C.

(57) ABSTRACT

A beacon with a transceiver for radio communication with vehicle OBUs of a road toll system, wherein the transceiver has a directional antenna and is configured to communicate wirelessly with OBUs on a selected channel directed via the directional antenna wherein the transceiver is additionally equipped with an omnidirectional antenna and is configured to transmit, before the beginning of a directional radio communication, by means of the omnidirectional antenna a channel reservation message and/or to check, before the beginning of a directional radio communication, by means of the omnidirectional antenna whether the selected channel is free.

6 Claims, 1 Drawing Sheet

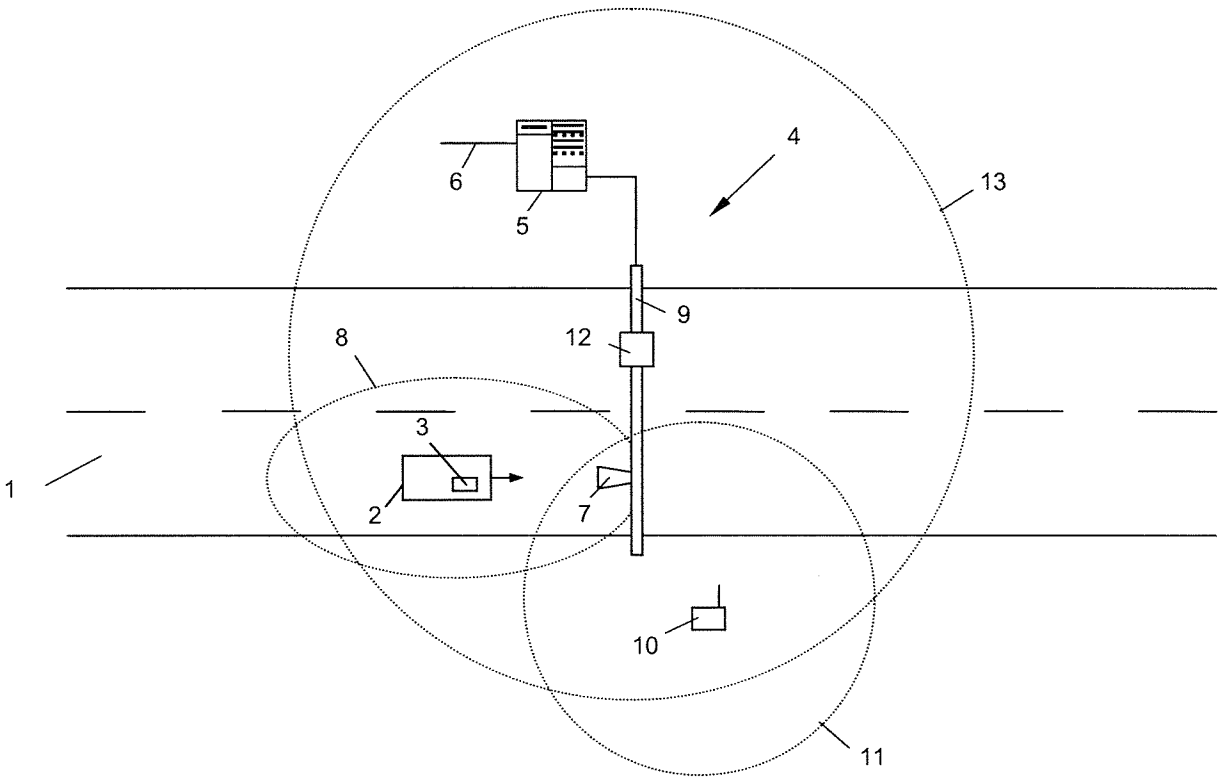
13
4
5
6
9
12
7
8
3
2
10
11
1

BEACON FOR A ROAD TOLL SYSTEM

CROSS-REFERENCE TO RELATED APPLICATION(S)

This application claims priority to European Patent Application No. 10 450 066.5, filed on Apr. 22, 2010, the contents of which are hereby expressly incorporated by reference.

FIELD OF THE INVENTION

The present invention relates to a beacon with a transceiver for radio communication with vehicle OBUs of a road toll system, wherein the transceiver has a directional antenna and is configured to communicate wirelessly and directionally with OBUs on a selected channel via the directional antenna.

BACKGROUND

Radio beacons with directional antennas, so-called directional beacons, are used to enable on the one hand a high power to be emitted and on the other hand the position of an OBU (onboard unit) to be located on the coverage range of the directional antenna. However, the use of a directional antenna leads to the problem that other transceivers active on the same channel are difficult to hear or cannot be heard at all outside the radio field of the directional antenna, and this can lead to a disturbance in the radio communication between the beacon and the OBU that is known as a "hidden node" problem.

Various methods for solving the hidden node problem are known such as CSMA/CA (carrier sense multiple access/collision avoidance) with the listen before talk (LBT) principle, as well as the RTS/CTS extension thereof with the exchange of a channel reservation message (request to send, RTS) and a reservation acknowledgement message (clear to send, CTS).

SUMMARY

In some embodiments, the invention is a beacon for a road toll system. The beacon includes a transceiver for radio communication with a plurality of vehicle OBUs of the road toll system. The transceiver includes a directional antenna and is configured to communicate wirelessly and directionally with OBUs on a selected channel via the directional antenna. The transceiver is additionally equipped with an omnidirectional antenna and is configured to transmit, before the beginning of a directional radio communication, by the omnidirectional antenna a channel reservation message and/or to check whether the selected channel is free, by means of the omnidirectional antenna, before the beginning of a directional radio communication.

According to some embodiments of the invention, the transceiver is configured in order to first check whether the selected channel is free and then to transmit the channel reservation message, which results in a particularly low susceptibility to interference.

The directional radio communication preferably occurs according to the DSRC (dedicated short-range communication) or WAVE (wireless access in a vehicle environment) standard.

In some embodiments, the beacon has a support mounted over a road, on which the directional antenna and the omnidirectional antenna are mounted.

BRIEF DESCRIPTION OF THE DRAWINGS

FIG. 1 is a block diagram showing a section of a road toll system with a beacon in plan view, according to some embodiments of the present invention.

DETAILED DESCRIPTION

The present invention provides a new type of radio beacon for a road toll system, which has a directional antenna to allow toll transactions with OBUs to be conducted in a restricted area with a high power density and with locating function and also an omnidirectional antenna for implementation of a CSMA/CA or RTS/CTS-CSMA/CA function in order to substantially exclude a disturbance of the directional communication as a result of hidden nodes.

FIG. 1 shows, in sections, a road 1, on which vehicles 2 with OBUs 3 move that can communicate wirelessly with road-side beacons 4 of a road toll system (not further shown). The exemplary beacon 4 comprises a transceiver 5, which connects to a central unit (not shown) of the road toll system via a data line 6, and can also communicate via a directional antenna 7 with an OBU 3 in the radio coverage area (radio field) 8 of the antenna 7. The radio communication between the transceiver 5 or its directional antenna 7 and the OBU 3 preferably occurs according to the DSRC or WAVE standard in a manner known to the person skilled in the art.

The directional antenna 7 is mounted on a support 9 directly above the road 1, for example, and can supply the radio field 8 with high power because of its directional characteristic. Moreover, because of the directional characteristic, an OBU 3 can be located on or in the region of the radio field 8.

The transceiver part of the OBU 3 typically also has a directional characteristic, for example, directed forwards and upwards through the windscreen of the vehicle 2 to be able to conduct a directional radio communication of high power density with the antenna 7.

Another transceiver device with, for example, an omnidirectional transceiver range 11, (e.g. a WLAN or WAVE client or node) located in the vicinity of the beacon 4 is given the reference 10. If the transceiver 10 uses the same radio channel as the beacon 4 and/or the OBU 3, the radio communication of the beacon 4 with the OBU 3 could interfere in certain local and temporal constellations of the transceiver 11 without the beacon 4 or the OBU 3 being able to recognise this, for example (hidden node problem).

To prevent this, the transceiver 5 of the beacon 4 is equipped with an additional omnidirectional antenna 12, the radio coverage range (radio field) of which is entered in an exemplary manner at 13 and comprises both the OBU 3 and the transceiver 10. The omnidirectional antenna 12 can be mounted, for example, on the same support 9 above the road 1 as the antenna 7.

Via the omnidirectional antenna 12 the transceiver 5 can now conduct a listen before talk function (LBT) corresponding to the CSMA/CA process, i.e. can—before the beginning of a directional radio communication via the antenna 7 with the OBU 3—"listen omnidirectionally" in the channel selected for the directional radio communication to check whether the channel is free. Alternatively or additionally hereto, the transceiver 5 can conduct an RTS/CTS function corresponding to the RTS/CTS-CSMA/CA process via the omnidirectional antenna 12, i.e. omnidirectionally transmit a channel reservation message RTS (request to send) in the channel selected for the directional radio communication with the OBU 3. The OBU 3 can answer with a channel reservation acknowledgement CTS (clear to send), for example, and other transceiver devices such as the transceiver device 10 can listen to one or both of the messages RTS, CTS and hold back from own transmissions during the estimated transmission time, as known to the person skilled in the art.

The LBT and RTS functions can also be conducted in succession, i.e. the transceiver 5 checks whether the selected channel is free (LBT) in a first step, and then transmits the channel reservation message RTS in a second step.

After checking whether the channel is free (LBT), or after receiving the channel reservation confirmation CTS, the entire radio communication of the transceiver 5 with the OBU 3 can be conducted via the directional antenna 7 or the transceiver 5 transmits via the omnidirectional antenna 12 and receives via the directional antenna 7.

In the present description the term "omnidirectional" is understood to be any desired omnidirectional characteristic that does not necessarily have to be a circular or spherical omnidirectional characteristic. In the present description the term "directional" is understood to be a directional characteristic that is not necessarily unidirectional, i.e. has only a single propagation lobe, but could also have multiple propagation lobes, for example, principal and secondary lobes, front and rear lobes etc.

Consequently, the invention is not restricted to the represented embodiments, but covers all variants and modifications that fall within the framework of the attached claims.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A beacon for a road toll system comprising:

a transceiver for radio communication with a plurality of vehicle onboard units (OBUs) of the road toll system, wherein the transceiver includes a directional antenna and is configured to receive wirelessly and directionally radio signals from OBUs on a selected channel via the directional antenna, wherein the transceiver further includes an omnidirectional antenna that is configured to receive communication to check whether the selected channel is free, before the beginning of a radio communication by the directional antenna, and wherein the transceiver is further configured to transmit communication only via the omnidirectional antenna and to receive communication only via the directional antenna after checking whether the selected channel is free.

2. The beacon according to claim 1, wherein the transceiver is configured to first check whether the selected channel is free and then to transmit a channel reservation message.

3. The beacon according to claim 1, wherein the directional radio communication occurs according to the DSRC or WAVE standard.

4. The beacon according to claim 1, further comprising a support mounted over a road, on which the directional antenna and the omnidirectional antenna are mounted.

5. The beacon according to claim 3, further comprising a support mounted over a road, on which the directional antenna and the omnidirectional antenna are mounted.

6. The beacon according to claim 1, wherein the omnidirectional antenna is configured to first omnidirectionally check whether the selected channel is free, then to transmit a channel reservation message, and when a channel reservation acknowledgement is received, to transmit said communication.

* * * * *